US005857598A

United States Patent [19]

Dunne

[11] Patent Number: 5,857,598

[45] Date of Patent: Jan. 12, 1999

[54] BABY SLING WITH IMPROVED RETAINER

[75] Inventor: Debra L. Dunne, Mission Viejo, Calif.

[73] Assignee: Noel Joanna, Inc., Rancho Santa Margarita, Calif.

[21] Appl. No.: 44,478

[22] Filed: Mar. 19, 1998

Related U.S. Application Data

[63] Continuation of Ser. No. 701,260, Aug. 22, 1996, abandoned.

[51] Int. Cl.[6] ..... A45F 3/02

[52] U.S. Cl. ..... 224/158; 224/616; 224/600

[58] Field of Search ..... 224/158–160, 224/616, 600, 602, 607

[56] References Cited

U.S. PATENT DOCUMENTS

| | | | |
|---|---|---|---|
| D. 332,865 | 2/1993 | Wilmink | 224/158 |
| 4,469,259 | 9/1984 | Krich, et al. | 224/160 |
| 4,544,088 | 10/1985 | Reding | 224/159 |
| 4,606,078 | 8/1986 | Tkacsik | 224/160 |
| 5,490,620 | 2/1996 | Bergqvist | 224/160 |

FOREIGN PATENT DOCUMENTS

| | | | |
|---|---|---|---|
| 2048839 | 2/1993 | Canada | 224/159 |

*Primary Examiner*—Charles R. Eloshway
*Attorney, Agent, or Firm*—Knobbe, Martens, Olson & Bear, LLP

[57] ABSTRACT

An infant sling carrier has a carrier panel terminating in a tail portion extending from one end. A pair of buckle rings is attached to the carrier panel at the opposite end and functions in concert with the tail portion to provide a sling of adjustable length for carrying an infant. The free end of the tail portion is provided with a safety stop member which can be maneuvered through the buckle rings when creating the sling, but which has a long dimension which will not pass through the buckle rings if the tail portion accidentally releases and slides through the buckle rings.

4 Claims, 2 Drawing Sheets

BABY SLING WITH IMPROVED RETAINER

The present application is a continuation of application Ser. No. 08/701,260, filed Aug. 22, 1996, now abandoned.

BACKGROUND OF THE INVENTION

This invention relates to infant carriers in general. More particularly, this invention relates to infant sling-type carriers.

Infant sling-type carriers are known which are used to facilitate the care and handling of an infant from birth up until an age at which the infant weighs approximately 30 pounds. Such carrier-type slings are typically fabricated from a flexible fabric and comprise a carrier panel terminating at one end in a tail portion, which serves as a sling tie. A pair of buckle rings is secured to the other end of the carrier panel and the rings' function in concert with the tail portion to secure the ends of the panel together in an adjustable fashion to provide the sling. The sling is formed by passing the tail portion through both of the buckle rings and doubling the tail portion back over one ring and under the other in a conventional fashion. This arrangement provides a friction tie serving to retain the tail portion in the buckle rings. To enhance the friction tie, the buckle rings may be provided with serrations along the inner diameter thereof in order to increase the frictional force holding the tail portion in the rings. One popular model of infant sling carrier includes padded side rails extending from end to end of the carrier panel, and a pillow portion secured to the carrier panel adjacent the end bearing the buckle rings, to provide additional comfort to the infant and the person wearing the sling.

While infant carrier slings of the above type have been found to be very effective and convenient for carrying infants, problems have been encountered on occasion with the friction tie afforded by the buckle rings and tail portion. In particular, on occasion the tail portion accidentally slips through the buckle rings, thereby undoing the sling. Such an occurrence is, at best, undesirable, and may be dangerous to the infant.

SUMMARY OF THE INVENTION

The invention comprises an infant sling carrier with an improved retainer for preventing complete separation of the tail portion from the buckle rings whenever the frictional force is accidentally released between the tail portion and the buckle rings and the tail portion slides through the buckle rings.

In its broadest aspect, the invention comprises an infant sling carrier including a carrier panel having first and second ends, the carrier panel having a tail portion extending from the first end, a pair of buckle rings attached to the carrier panel adjacent the second end for receiving the tail portion to provide a sling of adjustable length, and a stop member secured to the tail portion for preventing accidental slippage of the tail portion through the buckle rings.

The buckle rings have a central Aperture for accommodating the tail portion, and are preferably circular in shape. The stop member has a lateral dimension greater than the diameter of the central aperture. In the preferred embodiment, the stop member has an elongated generally rectangular shape with a long dimension greater than the diameter of the circular buckle rings.

The stop member functions to prevent the tail portion from being completely released from the buckle rings whenever the frictional force between the tail portion and the buckle rings is released. This is effected by virtue of the greater lateral dimension of the stop member than the aperture in the buckle rings.

For a fuller understanding of the nature and advantages of the invention, reference should be made to the ensuing detailed description, taken in conjunction with the accompanying drawings.

DETAILED DESCRIPTION OF THE PREFERRED EMBODIMENTS

Figure 1:
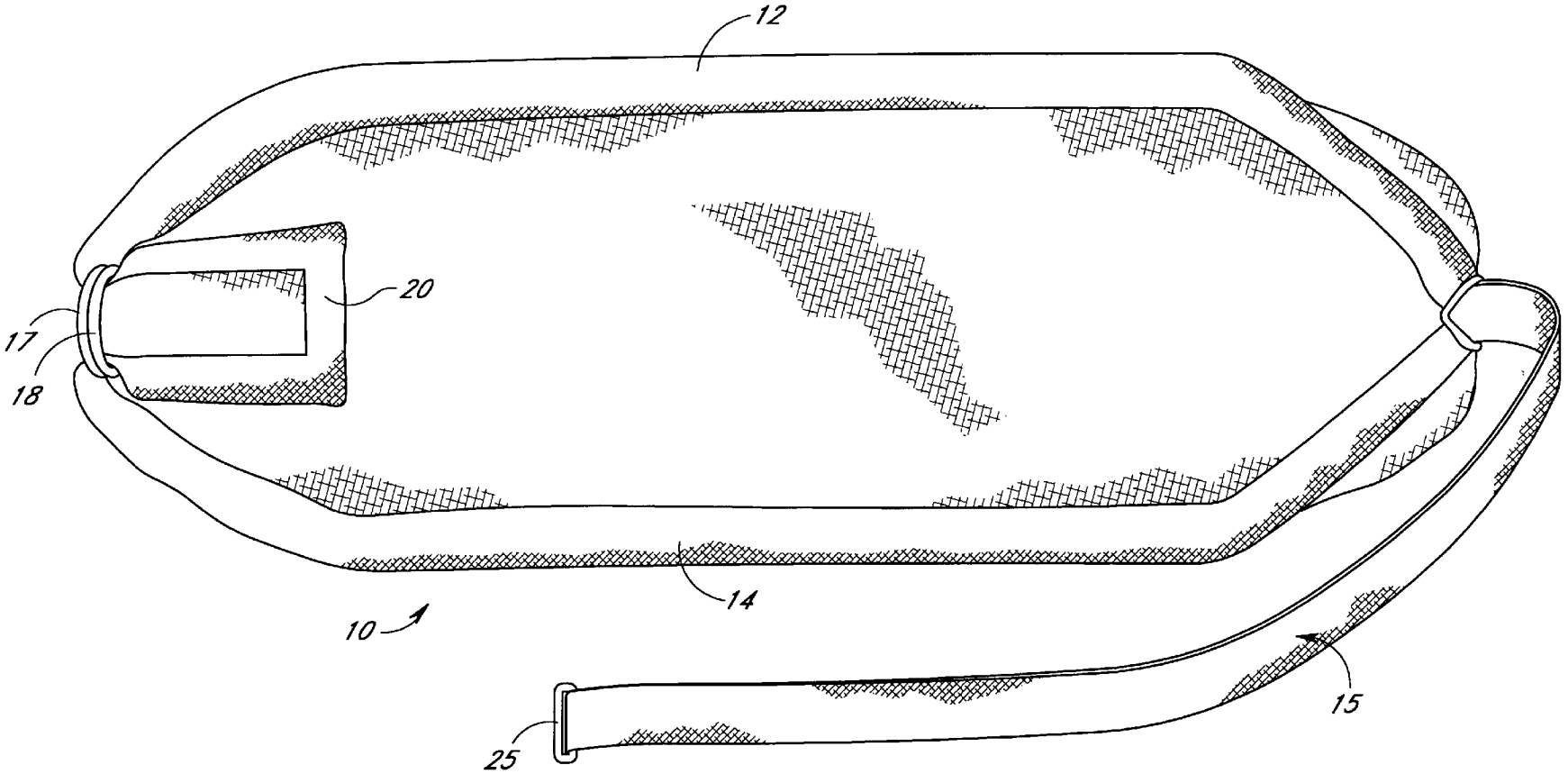
FIG. 1 is a plan view showing the infant sling carrier.
Figure 2:
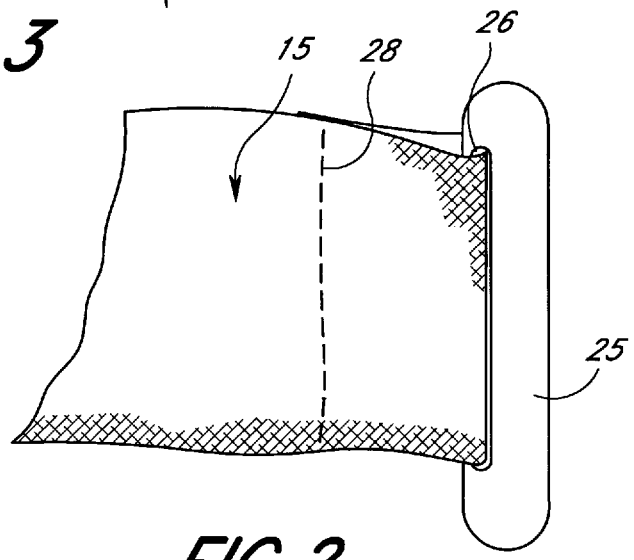
FIG. 2 is an enlarged view of the end of the tail portion showing the stop member.

Turning now to the drawings, FIGS. 1 and 2 illustrate the preferred embodiment of the invention. As seen in these figures, an infant sling carrier is comprised of a carrier panel generally designated with reference numeral 10. Carrier panel 10 is constructed of a flexible fabric material, such as cotton, polyester fiber, or any other fabric material suitable for the purpose. The carrier panel 10 has a pair of padded side rail portions 12, 14 extending end to end. Carrier panel 10 terminates at one end in a tail portion generally designated with reference numeral 15. Attached to the other end of carrier panel 10 is a pair of circular buckle rings 17, 18.

Attached adjacent the buckle rings is a padded pillow portion 20 which is provided for additional comfort for either the infant or the adult, depending on the manner in which the sling is worn.

As best shown in FIG. 2, attached to the free end of tail portion 15 is a stop member 25. In the preferred embodiment, stop member 25 is an elongated generally rectangular member having a central elongated aperture 26. To attach stop member 25 to tail portion 15, the free end of tail portion 15 is passed through aperture 26, doubled back and secured by any suitable means, such as reinforced stitching 28.

Figure 3:
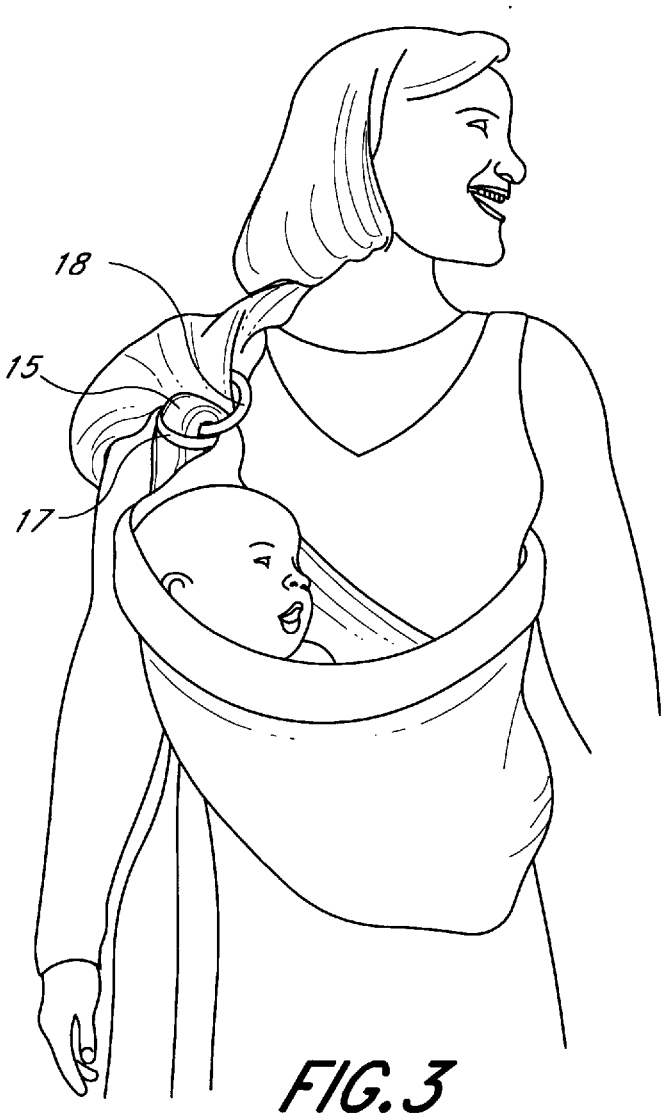
FIG. 3 is a perspective view illustrating the sling carrier worn by an adult and carrying an infant.

FIG. 3 illustrates the sling in use by an adult for carrying an infant, the infant being shown in one of several possible carrying positions. In all uses of the sling, the sling is formed by passing tail portion 15 and stop member 25 through buckle rings 17, 18, passing the end of tail portion 15 over one of the rings and back through the central aperture of the other ring. When a pulling force is exerted on the friction tie formed by buckle ring 17, 18 and tail portion 15, the friction between the buckle rings 17, 18 and the tail portion 15 normally prevents the securement tie from slipping. However, should this occur for any reason, as tail portion 15 slidingly releases, the stop member 25 eventually will encounter one of the buckle rings 17, 18. Due to the greater lateral dimension of stop member 25 (i.e., greater than the inner diameter of buckle rings 17, 18), the stop member 25 will not pass through the buckle rings and further sliding motion of tail portion 15 is prevented. This prevents the sling from accidentally releasing completely.

As will now be apparent, infant sling carriers provided with the stop member provide an additional level of safety for infant carriers of this type, which is highly desirable. In addition, the added cost of the stop member is relatively modest, thereby enabling this important safety feature to be added to sling carriers with only slight additional cost.

Lastly, addition of the stop member 25 to the infant sling carrier does not complicate the procedure for fashioning the sling, since the stop member 25 can be readily passed through the buckle rings 17, 18 by simply tilting the stop member 25 slightly sideways.

While the above provides a full and complete disclosure of the preferred embodiment of the invention, various modifications, alternate constructions and equivalents may be employed, as desired. For example, while circular buckle rings have been illustrated, other shapes such as oval, rectangular and irregular may be employed, as desired. Similarly, stop members 25 having other shapes than the generally elongated rectangular shape illustrated may be employed, as desired. Therefore, the above description and illustrations should not be construed as limiting the scope of the invention, which is defined by the appended claims.

What is claimed is:

1. An infant sling carrier consisting of:

a carrier panel having first and second ends, opposed longitudinal sides, and padded side rails extending between said first and second ends along upper terminal edges of said longitudinal side, said carrier panel terminating in a tail portion extending fro said first end;

a single pair of apertured buckle rings commonly attached to said second end of said carrier panel for receiving said tail portion by passing the end of said tail portion through the buckle rings, over one of said pair of rings, and back through the central aperture of the other of said pair of rings, said tail portion and buckle rings serving as an adjustable securing means for forming a sling to be completely and solely supported upon a single shoulder of a wearer by providing friction between the pair of buckle rings and tail portion; and a stop member secured to said tail portion, said stop member having a lateral dimension greater than the apertures in the buckle rings for preventing accidental slippage of said tail portion through either of said buckle rings.

2. The invention of claim 1 wherein said carrier panel further includes a pillow portion located adjacent said second end.

3. The invention of claim 7 wherein said carrier panel is constructed from a flexible fabric material.

4. The invention of claim 1 wherein said buckle rings are circular; and wherein said stop member has an elongated generally rectangular shape with a long dimension greater than the diameter of the circular rings.

* * * * *

UNITED STATES PATENT AND TRADEMARK OFFICE

CERTIFICATE OF CORRECTION

PATENT NO. : 5,857,598
DATED : January 12, 1999
INVENTOR(S) : Debra L. Dunne

It is certified that error appears in the above-identified patent and that said Letters Patent is hereby corrected as shown below:

Column 3, line 23, delete "fro said" and insert therefor --from said--.

Signed and Sealed this

Thirtieth Day of May, 2000

*Attest:*

*Attesting Officer*

Q. TODD DICKINSON

*Director of Patents and Trademarks*